US005683973A

United States Patent [19]

Post et al.

[11] Patent Number: 5,683,973

[45] Date of Patent: Nov. 4, 1997

[54] MILD BAR COMPOSITIONS COMPRISING BLENDS OF HIGHER MELTING POINT POLYALKYLENE GLYCOL(S) AND LOWER MELTING POINT POLYALKYLENE GLYCOL (S) AS PROCESSING AIDS

[75] Inventors: Albert Joseph Post, Teaneck; Frederick Silvio Osmer, Parsippany, both of N.J.; Michael Francis Petko, Mt. Vernon, N.Y.

[73] Assignee: Lever Brothers Company, Division of Conopco, Inc., New York, N.Y.

[21] Appl. No.: 601,917

[22] Filed: Feb. 15, 1996

[51] Int. Cl.[6] ..... C11D 3/32; C11D 3/43; C11D 17/00

[52] U.S. Cl. ..... 510/152; 510/141; 510/152; 510/153; 510/155; 510/156

[58] Field of Search ..... 510/141, 152, 510/155, 156, 153

[56] References Cited

U.S. PATENT DOCUMENTS

| | | | |
|---|---|---|---|
| 3,312,626 | 4/1967 | Hooker | 252/152 |
| 3,312,627 | 4/1967 | Hooker | 252/152 |
| 5,520,840 | 5/1996 | Massaro et al. | 252/174.17 |
| 5,540,854 | 7/1996 | Fair et al. | 510/152 |

FOREIGN PATENT DOCUMENTS

| | | |
|---|---|---|
| 93/07245 | 4/1993 | WIPO . |
| 95/13356 | 5/1995 | WIPO . |

*Primary Examiner*—Paul Lieberman
*Assistant Examiner*—Necholus Ogden
*Attorney, Agent, or Firm*—Ronald A. Koatz

[57] ABSTRACT

The present invention relates to bar compositions comprising a mixture of higher melting point and lower molecular weight (100 to about 1400) lower melting point polyalkylene glycol(s) in which use of the lower molecular weight polyalkylene glycol or glycols allows enhanced rates of extrusion from the plodder.

18 Claims, 1 Drawing Sheet

MILD BAR COMPOSITIONS COMPRISING BLENDS OF HIGHER MELTING POINT POLYALKYLENE GLYCOL(S) AND LOWER MELTING POINT POLYALKYLENE GLYCOL(S) AS PROCESSING AIDS

FIELD OF THE INVENTION

The present invention relates to mild synthetic personal cleansing bars in which small amounts of polyalkylene glycol or mixtures of polyalkylene glycol, wherein the use of polyalkylene glycol or glycols has relatively low melting point, has been found to enhance extrusion of bars through a soap plodder.

BACKGROUND

Synthetic detergent (syndet) personal cleansing bars that contain no soap or only a small amount of soap generally contain a substantial portion of another material which serves to give structure to the bar. Polyalkylene oxides such as polyethylene glycol, with a sufficiently high molecular weight to be a solid at room temperature, have been known to be excellent structurants for such mild personal cleansing syndet bars. Applicants copending application, U.S. Ser. No. 08/408,679 to Massaro, for example, describes a very mild syndet bar that can be formed with a level of syndet cleansing agents that is smaller than the level of structurants by weight.

In general, however, bars structured with a relatively high level of structurants are difficult to manufacture with conventional soap making method like milling, plodding and stamping. There is a delicate balance that must be achieved among the components of the personal cleansing bar which allows the material to be soft enough to extrude in soap refiners and plodders, yet not so soft that it cannot be shaped into bars by a stamping process.

Various components have been introduced into bar formulations to provide lubrication, i.e., make extrusion easier. For example, higher water levels enhance processability in extrusion equipment although the softness of the product is generally unacceptable for stamping. Higher water levels in the final product may also result in a mushy bar which would be unacceptable to the consumer. Another approach is to incorporate short chain fatty acids (e.g., coco) or silicone oils. Unfortunately, these components have a detrimental effect on the bar lather. Thus, there is a need to alter the rheological behavior of syndet personal cleansing bar formulations during the extrusion steps of bar making, without sacrificing performance in other parts of the manufacturing process and without sacrificing consumer attributes.

The approach taken by the inventors to alter the processability of syndet bars is to incorporate a small level of low molecular weight polyalkylene glycol(s), which have a melting point below 40° C. The use of the low melting weight polyalkylene glycols in bars structured with higher melting point polyalkylene glycols (which are normally difficult to extrude) enhances the rate of extrusion of the bars.

The use of water soluble structurants (component (b) of claim 1 of the subject invention) such as polyalkylene oxides (e.g., polyethylene glycol) in bars is not itself new.

U.S. Pat. Nos. 3,312,626 and 3,312,627 to Hooker, for example, both teach toilet bar compositions comprising polyethylene glycol wherein polymerization ranges from 100 to about 500 (MW about 4,000 to 20,000). These polyalkylene glycols, however, are not taught for use in combination with polyalkylene glycol(s) having a melting point below 40° C. (i.e., for enhancing processing). Further, the bars of these references utilize nonionic surfactant as essential surfactant (comprising 30% to 70% of bars) in contrast to the bars of the subject invention wherein anionic surfactants or mixtures of anionic and amphoteric surfactants predominate the surfactant system.

WO 95/13356 (assigned to Procter & Gamble) teaches personal cleansing bars comprising 10 to 70 parts sodium acyl isethionate (an anionic surfactant) and 4 to 15 parts liquid polyol (preferably glycerin). At pages 8–9, the reference teaches the binder may be polyalkylene glycol which preferably has low molecular weight (i.e., under 2,000, preferably under 1,500). Thus polyalkylene glycol would presumably have melting point under 40° C. The bars of the subject invention, however, must contain not only low molecular weight, low melting point polyalkylene glycol or mixture of polyalkylene glycols (Component (c) of claim 1 of the subject invention), but must contain greater than 10% polyalkylene glycol or mixture of polyalkylene glycols with melting point greater than 40° C. (Component (b) of claim 1) and the lower melting point polyalkylene glycol(s). That is, when the higher melting polyalkylene glycol structurants are used, unexpectedly it has been found that addition of small amounts of lower melting weight polyalkylene glycol or mixtures of polyalkylene glycols significantly enhances processing.

WO 93/07245 (assigned to Nephin) do teach blends of high molecular weight (higher melting) and low molecular weight (lower melting) polyalkylene glycol or glycols. These systems, however, must comprise at least 65% high molecular weight PEG and no more than about 20% (12% to 20%) synthetic detergent. The bars of the subject invention, by contrast, comprise greater than 10% to 60% (i.e., well below 65%), preferably 15% to 50%, preferably 15% to 45% high molecular, high melting weight polyalkylene glycol(s); and synthetic surfactant preferably comprises greater than 20%, more preferably greater than 25% of the bar composition.

Thus the use of small amounts of the lower melting point (less than 40° C.), lower molecular weight polyalkylene glycol (i.e., to enhance processing by extrusion) in bars having the specific composition of the subject invention (i.e., more than 10% to 60% of the less high molecular weight polyalkylene glycol; preferably greater than 20% surfactant system) is unknown.

Finally, applicants note applicants' copending application, U.S. Ser. No. 08/408,679 to Massaro, filed Mar. 22, 1995 and now allowed. This reference teaches use of polyalkylene glycols having molecular weight 1,500–10,000 as bar structurants. The reference, however, requires the structurant have melting point (MP) greater than 40° C. The polyalkylene glycols or mixtures of polyalkylene glycols of the subject invention (i.e., of Component (c) of claim 1) alone or together must have a MP of below 40° C. Further, there is no teaching or suggestion of using such low melting point polyalkylene glycol or mixture of polyalkylene glycols; or that such compounds might significantly enhance processing properties.

Accordingly, there is a need in the art to find ways to enhance bar processing in bars comprising relatively large levels of high molecular weight, higher melting polyalkylene glycol (i.e., greater than 10% to 60%, preferably greater than 10% to 50%) and comprising surfactant levels greater than 20%.

SUMMARY OF THE INVENTION

Suddenly and unexpectedly, applicants have found that when 0.1 to 10% by weight, preferably 1% to 8%, preferably 1% to 7% of a polyalkylene glycol or mixture of polyalkylene glycols with MP below 40° C. are added to compositions comprising:

(a) 10% to 60% by weight of a synthetic non-soap detergent or mixture of synthetic non-soap detergents;

(b) greater than 10% to 60%, preferably greater than 10% to 50% high molecular weight polyalkylene glycol having melting point (MP) greater than 40° C., preferably greater than 45° C., more preferably greater than 50° C.;

(c) 5% to 50% water insoluble structurant having MP greater than 40° C.;

(d) 1 to 14% water, preferably 1 to 10%, more preferably 2% to 8%;

(e) 0 to 25% water soluble starch; and (f) 0 to 10% of a salt of $C_8$ to $C_{22}$ monocarboxylic acid.

There is a tremendous improvement in processing such that the bars are processed much more easily (i.e., extruded at significantly higher rate through a plodder) compared to if the lower melting point polyalkylene glycol or mixture of polyalkylene glycols had not been added.

DETAILED DESCRIPTION OF THE INVENTION

Figure 1:
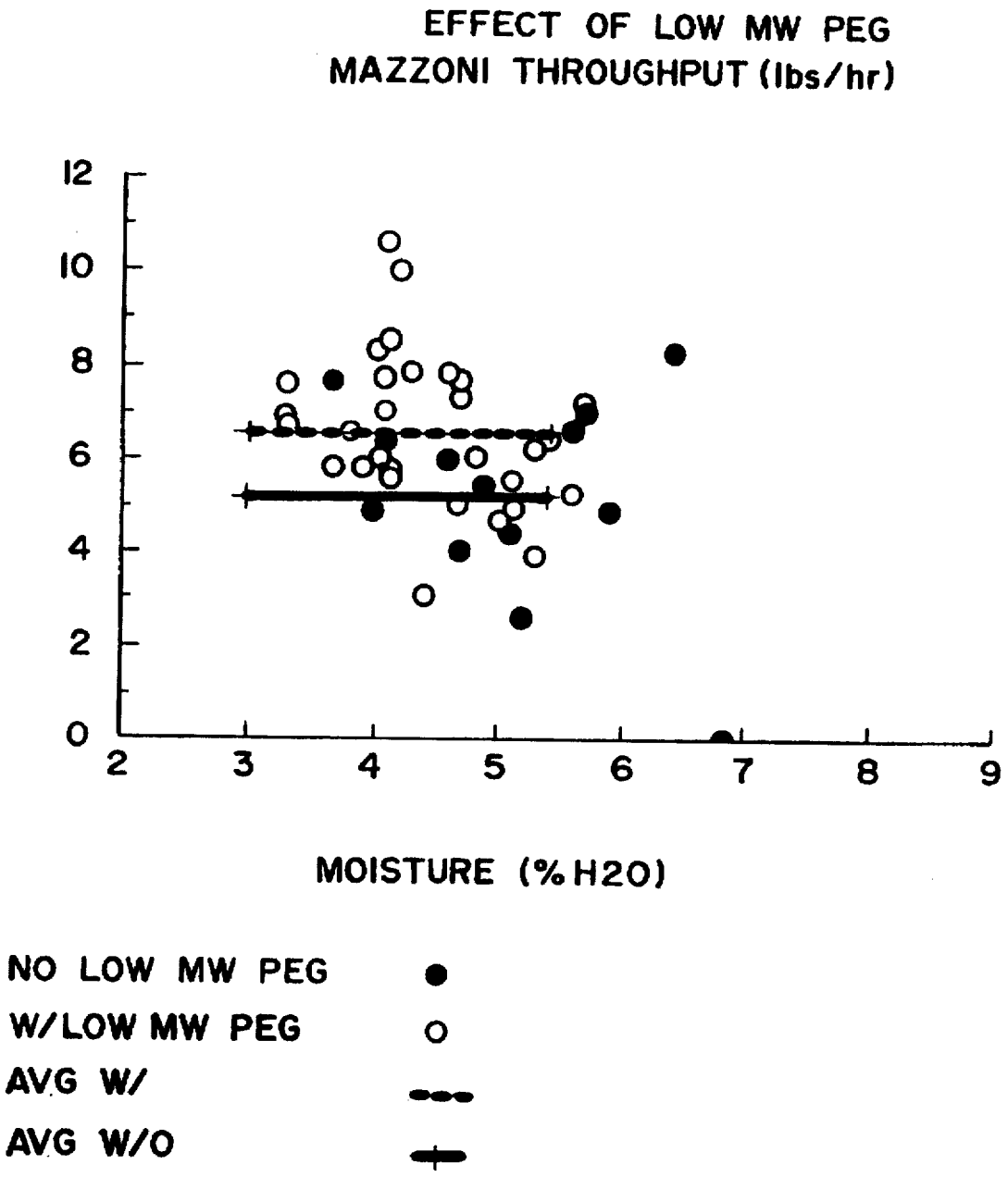
FIG. 1 shows the effect on the plodding rate (rate at which bars are extruded from a plodder prior to being stamped and cut for packaging) of the bars when higher melting point polyalkylene glycol (i.e., PEG 8000 alone) is used compared to when it is used in combination with one or more polyalkylene glycols having melting point under 40° C.

The present invention relates to mild soap bar compositions which comprise greater than 10% to 60%, preferably greater than 10% to 50% polyalkylene glycol, water soluble structurant having a melting point greater than 40° C., preferably greater than 45° C. and more preferably greater than 50° C.; and 10% to 60% of a synthetic non-soap detergent or mixtures of such detergent (preferably surfactant systems comprising anionic surfactant or surfactants, amphoteric surfactants or mixtures thereof). The bars also comprise water insoluble structurant (e.g., $C_{12}$–$C_{24}$ fatty acid), 1% to 14% water and optionally water soluble starch and $C_8$ to $C_{22}$ monocarboxylic acid.

Typically, such bars are made by mixing all the components at temperatures above 80° C. for about 15 to 120 minutes (i.e., sufficiently long to form molten mixture) cooling the mixture on a chill roll, mixing the chips/flakes formed from the chill roll in a refiner until the mass of chips is more pliable, and passing the refined mass into a plodder where the material is extruded, stamped and cut into bars.

Unexpectedly, applicants have found that when above 0.01 to 10% by wt., preferably 1% to about 8%, more preferably 1% to 7% of a polyalkylene glycol or mixture of polyalkylene glycols having a melting point below 40° C. is added to the compositions, the rate at which bars are extruded from the plodder (presumably a function of how pliable or sticky the batch mixture is after refining and before going into the plodder) is significantly increased.

It is preferred that the polyalkylene glycol is polyethylene glycol. The polyethylene glycol MW should range from 100 to 1,000, or the mixture of polyethylene glycols should have MW between 100 and below 1,500, such that the MP of the polyalkylene glycol or mixture of polyalkylene glycols is below 40° C.

The components of the bar are set forth in greater detail below.

Surfactant System

The bars of the invention comprise 10% to 60%, preferably greater than 20% to 50%, more preferably 25% to 50% of total bar composition of synthetic non-soap surfactant.

More specifically, the surfactant system will generally comprise at least one anionic surfactant, a zwitterionic surfactant or, preferably mixtures of anionic or anionics and zwitterionic surfactant.

The anionic surfactant which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium laurel ether sulfates are preferred.

The anionic may also be alkyl sulfosuccinates (including mono and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$$R^1O_2CCH_2CH(SO_3M)CO_2M; \text{ and}$$

amide-MEA sulfosuccinates of the formula $$R^1CONHCH_2CH_2O_2CCH_2CH(SO_3M)CO_2M$$

wherein $R^1$ ranges from $C_8$–$C_{22}$ alkyl and M is a solubilizing cation.

Sarcosinates are generally indicated by the formula $RCON(CH_3)CH_2CO_2M$, wherein R ranges from $C_8$–$C_{20}$ alkyl and M is a solubilizing cation.

Taurates are generally identified by formula $$R^2CONR^3CH_2CH_2SO_3M$$

wherein $R^2$ ranges from $C_8$–$C_{20}$ alkyl, $R^3$ ranges from $C_1$–$C_4$ alkyl and M is a solubilizing cation.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 40% by weight of the total bar composition. Preferably, this component is present from about 15% to about 35%.

The acyl isethionate may be an alkoxylated isethionate such as is described in Ilardi et al., U.S. Pat. No. 5,393,466, hereby incorporated by reference. This compound has the general formula

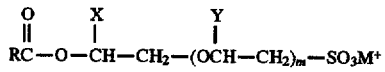

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

In general the anionic component will comprise from about 10 to 40% of the bar composition, preferably 15 to 35%.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

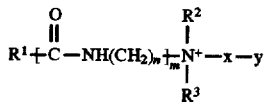

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

n is 2 to 4;

m is 0 to 1;

x is alkylene of 1 to 3 carbon atoms optionally substituted with hydroxyl, and y is $—CO_2—$ or $—SO_3—$ Suitable amphoteric detergents within the above general formula include simple betaines of formula:

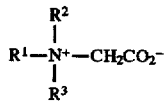

and amido betaines of formula:

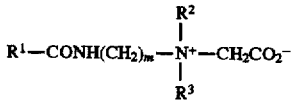

where m is 2 or 3.

In both formulae $R^1$ is alkyl or alkenyl of 7 to 18 carbons; and $R^2$ and $R^3$ are independently alkyl, hydroxyalkyl or carboxylalkyl of 1 to 3 carbons. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula

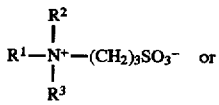

-continued

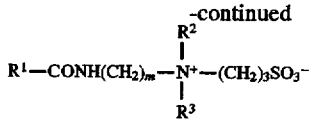

where m is 2 or 3, or variants of these in which $—(CH_2)_3SO_3^-$ is replaced by

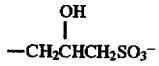

In these formulae $R^1$, $R^2$ and $R^3$ are as discussed for the amido betaine.

Amphoteric generally comprises 1% to 10% of the bar composition.

Other surfactants (i.e., nonionics, cationics) may also be optionally used although these generally would not comprise more than 0.01 to 10% b wt. of the bar composition.

Nonionic surfactants include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference and polyhydroxyamides such as described in U.S. Pat. No. 5,312,954 to Letton et al., hereby incorporated into the subject application by reference.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents" (Volume I & II) by Schwartz, Perry & Berch, both of which are also incorporated into the subject application by reference.

A preferred composition comprises 10% to 40% acyl isethionate and 1% to 10% betaine. The surfactants will comprise greater than 20%, preferably 25% to 40% of the bar composition.

Water Soluble Polyalkylene Glycol Structurant

Another critical compound of the bar is water soluble polyalkylene glycol structurant.

This component should comprise greater than 10% by wt. to 60%, preferably greater than 20% to 50% by wt. of the bar composition.

The polyalkylene glycol structurant has a melting point of 40° to 100° C., preferably 45° C. to 100° C., more preferably 50° to 90° C.

Materials which are envisaged as the water soluble structurant (b) are moderately high molecular weight polyalkylene oxides of appropriate melting point and in particular polyethylene glycols or mixtures thereof.

Polyethylene glycols (PEG's) which may be used may have a molecular weight in the range 1,500–20,000.

It should be understood that each product (e.g., Union Carbide's Carbowax® PEG-8,000) represents a distribution of molecular weights. Thus PEG 8,000, for example, has an average MW range of 7,000–9,000, while PEG 300 has an average MW range from 285 to 315. The average MW of the product can be anywhere between the low and high value, and there may still be a good portion of the material with MW below the low value and above the high value.

In some embodiments of this invention it is preferred to include a fairly small quantity of polyalkylene glycol (e.g., polyethylene glycol) with a molecular weight in the range from 50,000 to 500,000, especially molecular weights of around 100,000. Such polyethylene glycols have been found to improve the wear rate of the bars. It is believed that this is because their long polymer chains remain entangled even when the bar composition is wetted during use.

If such high molecular weight polyethylene glycols (or any other water soluble high molecular weight polyalkylene oxides) are used, the quantity is preferably from 1% to 5%, more preferably from 1% or 1.5% to 4% or 4.5% by weight of the composition. These materials will generally be used jointly with a larger quantity of other water soluble structurant (b) such as the above mentioned polyethylene glycol of molecular weight 1,500 to 10,000.

Some polyethylene oxide polypropylene oxide block copolymers melt at temperatures in the required range of 40° to 100° C. and may be used as part or all of the water soluble structurant (b). Preferred here are block copolymers in which polyethylene oxide provides at least 40% by weight of the block copolymer. Such block copolymers may be used, in mixtures with polyethylene glycol or other polyethylene glycol water soluble structurant.

Low Molecular Weight Polyalkylene Glycol

The key to the invention is the discovery that when above 0.01 to 10% by wt., preferably 1% to about 8%, more preferably 1% to 7% of a polyalkylene glycol or mixture of polyalkylene glycols having a MP below 40° C. is added to the compositions, the throughput extruded by a soap refiner and plodder is enhanced (see FIG. 1). An example of a polyalkylene glycol is polyethylene glycol. The polyethylene glycol MW should range from 100 to 1,000, or the mixture of polyethylene glycols should contain MW between 100 and below 1,500, such that the MP of the polyalkylene glycol or mixture of polyalkylene glycols is below 40° C. As noted above, the MW specifications refer to average molecular weight distributions.

Water Insoluble Structurant

The water insoluble structurants (d) are also required to have a melting point in the range 40°–100° C., more preferably at least 50° C., notably 50° C. to 90° C. Suitable materials which are particularly envisaged are fatty acids, particularly those having a carbon chain of 12 to 24 carbon atoms. Examples are lauric, myristic, palmitic, stearic, arachidonic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

The relative proportions of the water soluble structurants (b) and water insoluble structurants (d) govern the rate at which the bar wears during use. The presence of the water insoluble structurant tends to delay dissolution of the bar when exposed to water during use and hence retard the rate of wear.

Preferably the total quantity of component (d) is from 10% to 40% by weight of the composition.

Other Components

Water should be present in the bar compositions at 1% to 14% by wt., preferably 1% to 10% by wt., preferably 2% to 8% by wt. of the composition.

The compositions may optionally contain at least some material which does not melt below 100° C. to function as additional bar structurant. This material should be present in an amount of at least 0% to 25% by wt. of the composition, preferably 5 to 15%.

This material must be a "true" water soluble material and, as such, does not include partially soluble starches such as the corn or potato starches, but instead the fully soluble starches, such as maltodextrin.

By water soluble is meant that a 10% by wt. or greater solution of the starch in water will dissolve to form a clear or substantially clear solution (except for small amounts of insoluble residue which may impart a translucent haziness to the otherwise clear solution).

Some soap, that is to say salts of monocarboxylic fatty acids having chain lengths of 8 to 22 carbon atoms, may also be optionally included in the bar compositions of this invention (claim component (g)). The amount is desirably not greater than 10% by weight of the composition.

We have found that if water insoluble soap is included, it is advantageous in reducing the wear rate of the bars. Such water insoluble soaps are salts of saturated fatty acids having chain lengths of 16 to 22 carbon atoms, especially 16 to 18. Preferably these salts are sodium salts.

If water insoluble soap is present in the composition, the amount of it desirably does not exceed 20% by weight of the composition, for example lying in a range from 3% to 9.5% by weight, more preferably 5% to 9%.

All percentages mentioned are intended to be by weight unless otherwise noted.

The following examples are meant for illustrative purposes only and are not intended to limit the claims in any way.

Unless indicated otherwise all percentages are intended to be by weight.

Processing

The personal cleansing bars of the invention were prepared by vigorously mixing the ingredients in a 150 lb. Drais mixer at temperatures in excess of 85° C. for 30 minutes to one hour and 30 minutes. The moisture level of the batch was reduced to a level between 3 and 5.5% by weight during the final mixing. The mixture was then cooled rapidly on a chill roll to form brittle flakes. The flakes may optionally be mixed with perfume in a solid mixer. The flakes were then refined by one or more stages of extrusion to form pliable pellets, which were then extruded in one last stage to form long bars.

Formulations

Two formulations are provided in Table 1. In each case, a comparative formulation without low MW PEG was incorporated into the formulation. The low MW PEG replaced the high MW PEG structurant when it was incorporated.

TABLE 1

Mild Personal Cleansing Bar Formulations (1)

| Component | A | A Comparative | B | B Comparative |
|---|---|---|---|---|
| Sodium Cocoisethionate | 27.0 | 27.0 | 27.0 | 27.0 |
| Cocoamidopropyl betaine | 5.0 | 5.0 | 5.0 | 5.0 |
| PEG 8,000 | 20.4 | 25.4 | 22.4 | 27.4 |
| PEG 1,450 | 2.95 | 0.0 | 2.95 | 0.0 |
| PEG 300 | 2.05 | 0.0 | 2.05 | 0.0 |
| Stearic Acid | 20.0 | 20.0 | 17.0 | 17.0 |
| Sodium Stearate | 8.0 | 8.0 | 5.0 | 5.0 |
| Maltodextrin | 6.0 | 6.0 | 10.0 | 10.0 |
| Miscellaneous; salts, perfume, preservatives, TiO2 | 3.6 | 3.6 | 3.6 | 3.6 |
| Water (Nominal) | 5.0 | 5.0 | 5.0 | 5.0 |

(1) All components except water are specified in parts by weight. A nominal water level of 5 parts is specified. Actual formulas will vary in water from as low as 2 to as high as 8% by weight.

EXAMPLES 1–8

The following Example 1–8 formulations were prepared as described above. Refining and plodding was done by a two stage Mazzoni extruder. Product throughputs were obtained over five minute periods. Table 2 provides the base formula, the moisture percent by weight, and the measured throughput.

TABLE 2

Extrusion Throughputs for Formulations With and Without Low MW PEG

| Example | Base Formula | Moisture Wt. % | Throughput lbs/min. |
|---|---|---|---|
| 1 | A comp. | 5.1 | 4.4 |
| 2 | A | 5.1 | 4.9 |
| 3 | A | 5.4 | 6.4 |
| 4 | A | 4.8 | 6.0 |
| 5 | B comp. | 4.0 | 6.0 |
| 6 | B | 3.8 | 6.6 |
| 7 | B comp. | 5.9 | 4.9 |
| 8 | B | 5.6 | 5.2 |

Moisture can only be controlled to within 0.2% during batch making so formulations with slightly different moisture levels are compared. Examples 2–4 show that base formula A shows considerable improvement in throughput over the comparative Example 1, which does not have low MW PEG. The throughput of Formula B is also enhanced by low MW PEG, as the example pair 5 and 6 and pair 7 and 8 show.

EXAMPLE 9

In addition to direct comparisons on a formula by formula basis (Examples 1–8), results of nearly 50 batches prepared in our pilot plant as discussed above and extruded by a Mazzoni extruder are summarized in FIG. 1. The formulations range in composition as described in Table 3. The range of formulations for batches prepared without low MW PEG are essentially equivalent to the range of formulations prepared for batches which incorporated low MW PEG. The average of all runs with low MW PEG was plotted as a dashed line and the average of all runs without low MW PEG was plotted as a solid line. The Figure indicates a consistent trend toward enhanced throughput when low MW PEG was present. Specifically, the Figure shows that there is a significant enhancement in the average extrusion rate using bars with low molecular weight PEG versus those without.

TABLE 3

Range of Levels of Structurant and Low MW PEG for Batches Shown in FIG. (1)

| Component | Range |
|---|---|
| PEG 8,000 | 27–34 |
| Stearic Acid | 13–20 |
| Sodium Stearate | 2–8 |
| Maltodextrin | 6–11 |
| Low MW PEG (2) | 0 or 5 |

(1) All other components are fixed at the levels shown for the formulations of Table 1.
(2) The low MW PEG is included at 0 or 5 parts. At 5 parts, it is comprised of 2.05 parts of PEG 300 and 2.95 parts of PEG 1,450.

We claim:

1. Detergent composition comprising:

(a) 10 to 60% by weight of a synthetic, non-soap detergent, or mixture of synthetic non-soap detergents;

(b) greater than 10% to 60% by weight of a water-soluble structurant which is neither soap nor a non-soap detergent and which has a melting point in the range 40° to 100° C.;

(c) 0.1 to 10% by weight polyalkylene glycol or mixture of polyalkylene glycols wherein said glycol or wherein each of the glycols in said mixture has a melting point below 40° C. is a polyethylene glycol having MW of 100 to 1,000 or a mixture of polyethylene glycols wherein each of the polyethylene glycols in said mixture has a MW of from 100 to below 1,000;

(d) 5% to 50% by wt. of a water insoluble structurant which is neither soap nor non-soap detergent and has a melting point in the range 40° to 100° C.;

(e) 1 to 14% by wt. water;

(f) 0 to 25% water soluble starch; and (g) 0 to 10% salt of a $C_8$ to $C_{22}$ monocarboxylic acid.

2. A composition according to claim 1, wherein component (a) comprises at least one anionic surfactant, zwitterionic surfactant or mixtures thereof.

3. A composition according to claim 2, wherein the anionic component comprises acyl isethionate, alkali metal alkyl ether sulfate or mixtures thereof.

4. A composition according to claim 2, wherein the amphoteric is selected from the group consisting of betaines, amido betaines, sulpho betaines or mixtures thereof.

5. A composition according to claim 3, wherein isethionate comprises 10% to 40% of the bar composition.

6. A composition according to claim 4, wherein the amphoteric comprises 1% to 10% of the bar composition.

7. A composition according to claim 1, wherein detergent or mixture of detergent comprises greater than 20% of bar composition.

8. A composition according to claim 1, wherein structurant has MP of 45° C. to 100° C.

9. A composition according to claim 1, wherein structurant has MP of 50° C. to 90° C.

10. A composition according to claim 1, wherein structurant is polyethylene glycol having MW greater than 1,500 to 20,000.

11. A composition according to claim 10, wherein component (b) additionally comprising about 1% to 5% polyalkylene glycol having MW of about 50,000 to 500,000.

12. A composition according to claim 1, comprising greater than 10% to 50% water soluble structurant (b).

13. A composition according to claim 1, comprising greater than 10% to about 40% water soluble structurant (b).

14. A composition according to claim 1, wherein component (d) is a $C_{12}$ to $C_{24}$ fatty acid.

15. A composition according to claim 1, comprising 1 to 10% water.

16. A composition according to claim 1, comprising 2 to 8% water.

17. A composition according to claim 1, wherein the starch is maltodextrin.

18. A composition according to claim 1, wherein component (g) is sodium stearate.

* * * * *

UNITED STATES PATENT AND TRADEMARK OFFICE

CERTIFICATE OF CORRECTION

PATENT NO. : 5,683,973

DATED : November 4, 1997

INVENTOR(S) : Post et al.

It is certified that error appears in the above-indentified patent and that said Letters Patent is hereby corrected as shown below:

In claim 1(c), which appears in column 10, lines 31 and 32, please delete "has a melting point below 40° C."

Signed and Sealed this

Twenty-sixth Day of May, 1998

*Attest:*

Bruce Lehman

BRUCE LEHMAN

*Attesting Officer*

*Commissioner of Patents and Trademarks*